United States Patent [19]

Stiers

[11] Patent Number: 4,599,958

[45] Date of Patent: Jul. 15, 1986

[54] METHOD AND APPARATUS FOR MAKING PLEATED DRAPERIES OF ARBITRARY LENGTHS

[75] Inventor: Joseph D. Stiers, Phoenix, Ariz.

[73] Assignee: Multiple-Housing Drapery Services, Inc., Phoenix, Ariz.

[21] Appl. No.: 712,154

[22] Filed: Mar. 15, 1985

[51] Int. Cl.[4] ..... D05B 97/00; D05B 35/08; A41H 43/00

[52] U.S. Cl. ..... 112/262.1; 112/131; 112/132; 223/30; 223/32

[58] Field of Search ..... 112/262.1, 262.3, 131, 112/130, 132, 134, 135; 223/28, 29, 30, 32, 31

[56] References Cited

U.S. PATENT DOCUMENTS

| | | | |
|---|---|---|---|
| 2,708,059 | 5/1955 | Petzal et al. | 223/30 |
| 2,850,218 | 9/1958 | Gibson et al. | 223/30 |
| 3,133,466 | 5/1964 | Seifert | 112/131 X |
| 3,591,061 | 7/1971 | Boyes | 223/32 |
| 3,661,106 | 5/1972 | Huddelston | 112/131 X |
| 3,760,746 | 9/1973 | Portilla, Jr. | 223/31 X |
| 3,858,768 | 1/1975 | Hales et al. | 223/32 |
| 4,015,748 | 4/1977 | Golden | 223/32 |
| 4,245,576 | 1/1981 | Crawford et al. | 112/262.1 |

*Primary Examiner*—H. Hampton Hunter
*Attorney, Agent, or Firm*—Cahill, Sutton & Thomas

[57] ABSTRACT

French pleated draperies of any selected length are manufactured by serging panels of fabric together to provide a wide section of material. After hemming the bottom and serging a strip of buckram to the top of the section, the upper and lower edges of the section then are positioned on a pleat marking table. Ultraviolet markings then are made on the fabric to produce invisible marks at the locations of the centers of the pleats to be formed and also to indicate where fan folds should be formed at the bottom of the drapery. After a desired width of the section has been pleat marked, that width is cut from the section of material. After sewing the side hems, pleats are formed using a conventional pneumatic pleat forming machine by illuminating each ultraviolet sensitive pleat center mark with a center blade of the pleat forming machine and then forming that pleat. The pleat then is sewn by two pleat sewing machines. Rapid, precise fan folding of the pleated drapery is manually performed with a worker at each end forming fan folds in alignment with the pleats and the ultraviolet fan fold marks.

15 Claims, 15 Drawing Figures

Figures 1, 1A, 1B, 2B:
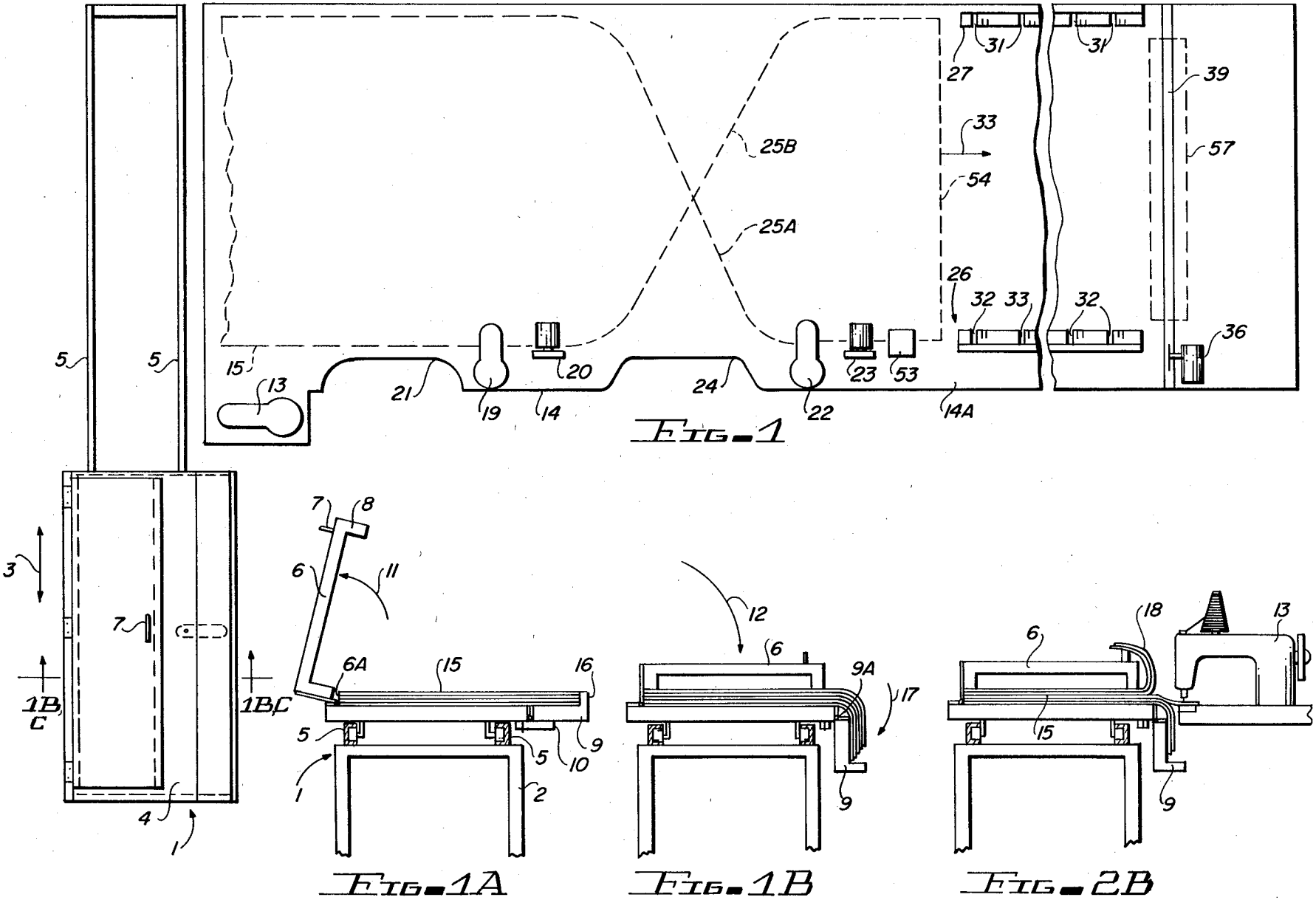

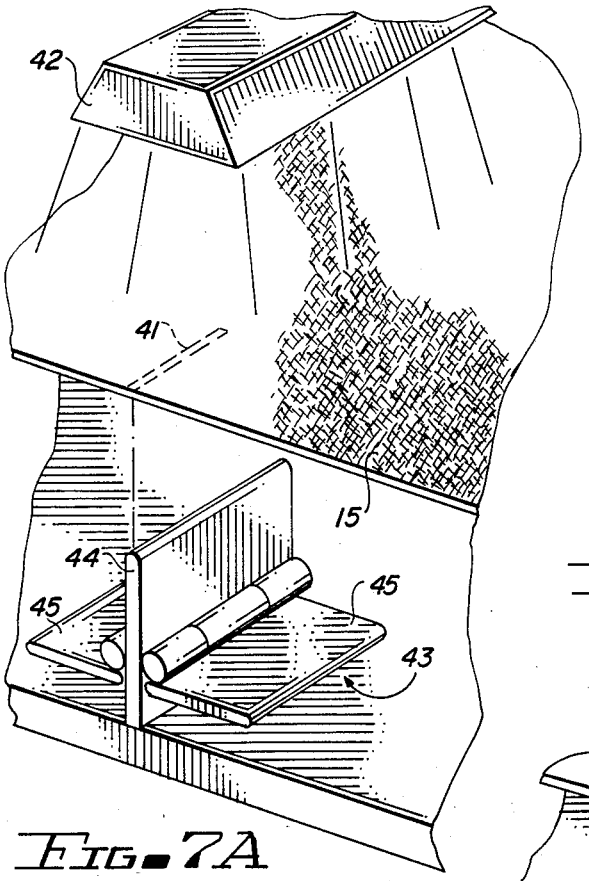
FIG. 7A
FIG. 7B
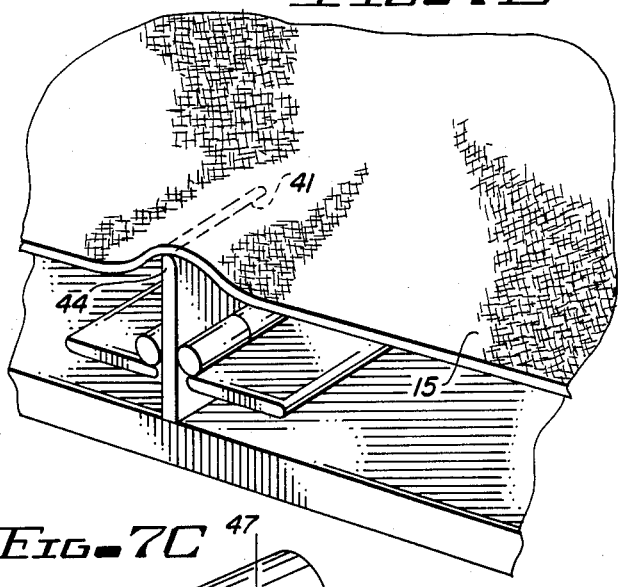
FIG. 7C
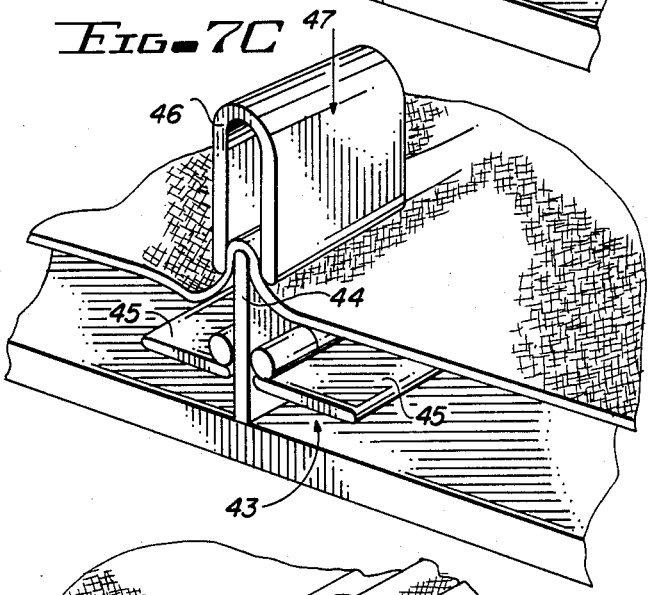
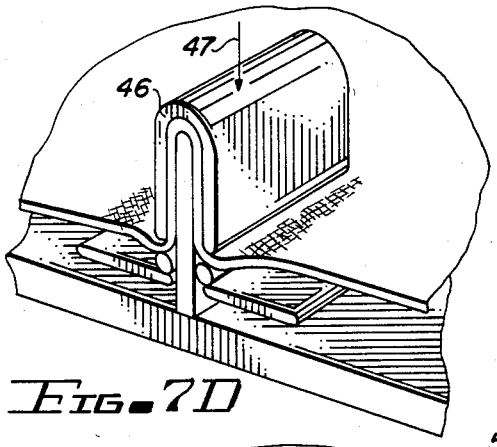
FIG. 7D
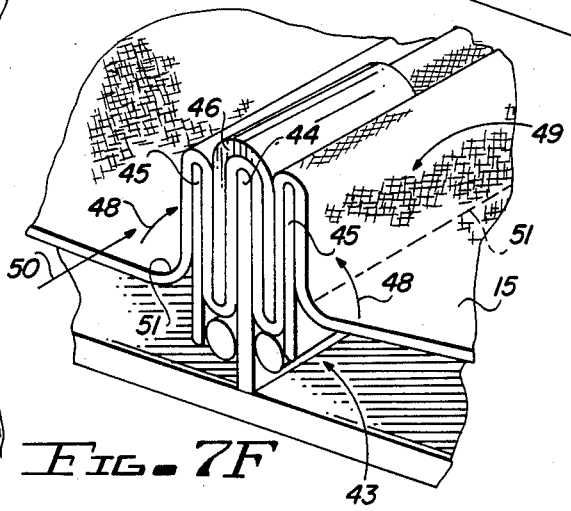
FIG. 7F
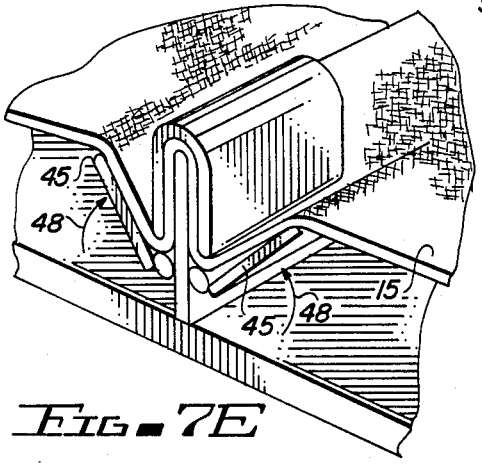
FIG. 7E

METHOD AND APPARATUS FOR MAKING PLEATED DRAPERIES OF ARBITRARY LENGTHS

BACKGROUND OF THE INVENTION

The invention relates to improved methods and apparatus for making pleated draperies, and especially to methods and apparatus that avoid the difficulties associated with use of prior pleat marking machines and prior fan folding machines and techniques.

In the drapery industry, a drapery with a type of pleat called a "French Pleat" is well established as the most popular type. A drapery having French pleats is able to maintain a regulated "fullness" when covering a window and, when the drape is opened, to cover a minimum amount of window and/or wall space. Unfortunately, draperies with French pleats are time consuming to manufacture, and hence are expensive. In order to understand why, it will be helpful to briefly describe the state of the art for manufacture of "standard" draperies with French pleats. As most people know, French pleated draperies have sewn in pleats along their top borders. Drapery hooks are installed in the pleats to allow the draperies to be hung from a drapery rod assembly. Normally, standard draperies are manufactured from an integral number of standard sized "panels" or "widths" of fabric. Therefore, the size of the section of fabric including an integral number of panels "serged" or sewn together does not usually precisely match the "fullness" to correspond to a particular rod size to which the drapery is to be attached or hung. In the usual French pleat manufacturing processes, a machine called a "pleat marker" is used in order to get the proper number of pleats of proper "fullness". The "fullness" of the drapery is a composite measure of the spacing between the pleats and the amount of fabric in each pleat, for a particular section of fabric containing an integral number of panels. The pleat marking machine is attached to the top surface of a table referred to as a "tabling" table, on which the drapery is laid out adjacent to the pleat marking machine. A worker then lays the buckram across the top of the drape and refers to a reference book that indicates a setting to be made on the pleat marking machine for a particular fullness of drapery being manufactured. This allows the machine to be set so that a plurality of laterally slidable, equally spaced devices referred to as pleat markers are equally spaced along one edge of the drapery fabric. Later, if a wider piece of fabric is to be pleat marked, the spacing between pleats will be different than the spacing for a narrower piece of fabric after adjustment of the pleat marking machine to the wider width piece of fabric. After the pleat marking machine has been properly set, a worker uses a marker to make pleat sewing marks on the fabric, using the pleat markers as guides. Note that these pleat marking machines mark where the pleats are to be sewn, not the center of the pleat. The foregoing pleat marking procedure is very time-consuming in manufacture of standard widths of draperies. Subsequent steps include sewing buckram material along the upper edge of the section of fabric. The partially completed drapery is then moved to a pleating machine. The pleat marks are then matched and the pleat is formed by a pleat forming machine or by hand, which shapes the pleat in accordance with the amount of material that has been allowed for forming the pleat, which in turn is determined by the pleat marking process.

Then, the preformed pleat is stitched using a pleat sewing machine. The next step in the manufacture is to run the entire drapery through a fan folding machine which has interdigitated structures that form the folds so that the final fan folding process can be completed in a relatively wrinkle-free operation.

The foregoing pleat marking procedure and the fan folding procedure are very time-consuming, and add greatly to the cost of making draperies.

In efforts to overcome these problems, a large number of other drapery structures and manufacturing techniques have been developed. For example, draperies of different structures are manufactured under such trademarks as BEAUTY PLEAT, SPRING CREST, SNAP-A-PLEAT, and others. Each of these types of draperies has utilized different structures to create the "fullness" desirable for a drape, but in doing so, has encountered other problems, such as requiring specialized rods, springs, glides, etc., and has been subject to a number of other problems. Consequently, there has been a general lack of acceptance by the market of all types of draperies other than French pleat draperies.

To summarize, all prior approaches to manufacture of French pleated draperies involve measurement of the width of fabric for each drapery "by the panel", and the pleat marking operation is adjusted to produce an integral number of pleats for that drapery. This approach has resulted in excessive amounts of labor in the pleat marking operations and has resulted in waste of fabric, and has also resulted in some nonuniformity in the fullness and spacing of different draperies composed of different numbers of panels.

Accordingly, there clearly remains an unmet need for an improved, less expensive method for manufacturing draperies with French pleats, especially with equally spaced, equally sized pleats, regardless of the size of the window to be covered thereby.

SUMMARY OF THE INVENTION

Accordingly, it is an object of the invention to provide an improved technique and apparatus for making draperies with French pleats.

It is another object of the invention to provide an apparatus and technique for making draperies with French pleats which are all of the same fullness and spacing regardless of the width of the drapery to be made.

Briefly described, and in accordance with one embodiment thereof, the invention provides a method of making French pleated draperies by positioning the top edge and bottom edge of a section of drapery material beneath first and second guide members, respectively, wherein each of the guide members has a plurality of parallel elongated guide slots perpendicular to the edges of the section of drapery material and having center-to-center spacing equal to the distance between desired pleat center marks to be formed on the piece of drapery material, and pressing an ultraviolet-sensitive marker through each of the guide slots to make invisible pleat center marks along the top edge of the section of drapery material and fan fold marks along the bottom edge of the piece of drapery material. Subsequently, the pleat center marks are illuminated by ultraviolet light to make them visible. The ultraviolet-illuminated pleat center marks are aligned precisely with the center blade of a pleat forming machine, which then is operated to preform the pleat, which then is slide off of the pleat forming machine and is completed by stitching it with an L-tacker machine. In the described embodiment of the invention, the section of drapery material is formed by serging together adjacent edges of a stack of drapery material aligned with the fence of a laterally movable serging table. The fence is dropped after the stack of panels is clamped in place by a fabric clamp. Edges of consecutive pairs of adjacent panels are passed through the sewing head of a serging machine by moving the serging table past the sewing head of a serging machine, so as to complete the manufacture of the section. Conventional bottom hemming and buckram serging steps are performed prior to the ultraviolet-sensitive pleat marking operation. The ultraviolet-sensitive marker is also utilized to mark the width of subsections of the drapery material. The subsections are cut to width after illuminating the cut-off marks by ultraviolet light and aligning them with the blade guide of a cut-off knife. After conventional side hemming steps have been completed and the above-mentioned pleat forming operation has been completed, two workers perform a fan folding function, one worker standing at the top edge of the drapery and the other at the bottom edge. The worker at the bottom edge of the drapery fan folds the bottom edge of the drapery, forming folds at each of the fan fold marks which are illuminated by ultraviolet light to make them visible. The top edge of the drapery is fan folded at the center of each French pleat.

DESCRIPTION OF THE INVENTION

Referring now to FIG. 1, reference numeral 1 designates a serging table on which a large number of "panels" of drapery fabric can be placed. In the present embodiment of the invention, each panel is 41 to 44 inches wide and of any predetermined length. (However, any width of fabric can be used.) The purpose of the serging table 1 and a serging machine 13 is to stitch the side edges of the panels together to form a continuous width of drapery fabric approximately 70 feet wide by any predetermined length. Note that this width is limited only by the bulk of the material. With future machinery the size will be virtually unlimited.

It should be appreciated that in the art of drapery making, the conventional terminology is to refer to the distance from the top to the bottom of a drapery as its "length" and to refer to the distance from its right edge to its left edge as its "width". This terminology also is used in referring to the pieces of drapery material from which the draperies are ultimately made.

Serging table 1 includes a base 2 (FIG. 1B) supporting two horizontal rails 5. A table top 4 moves horizontally in the direction of arrows 3 of FIG. 1 along the rails 5 in order to move the panels being serged together past the sewing head of serging machine 13.

As best seen in FIGS. 1A and 1B, table top 4 has a fabric clamp 6 attached by a hinge 6A to the rear edge of table top 4. Table top 4 also has a leaf 9 attached by means of a hinge 9A (FIG 1B) to its front edge. Leaf 9 has a perpendicular fence 16 attached to its front edge. The fabric panels 15 are aligned with the inner edge of fence 16 after being stacked on the upper surface of table top 4. Then fabric clamp 6, which has been raised by means of handle 7 in the direction indicated by arrow 11 to allow the placement of the fabric panels 15, is lowered so that its front edge 10 rests on the stack of fabric panels 15, as indicated by arrow 12 in FIG. 1B. The leaf 9 then is dropped by retracting a leaf lock element 10, as indicated by arrow 17 in FIG. 1B.

Figure 2A:
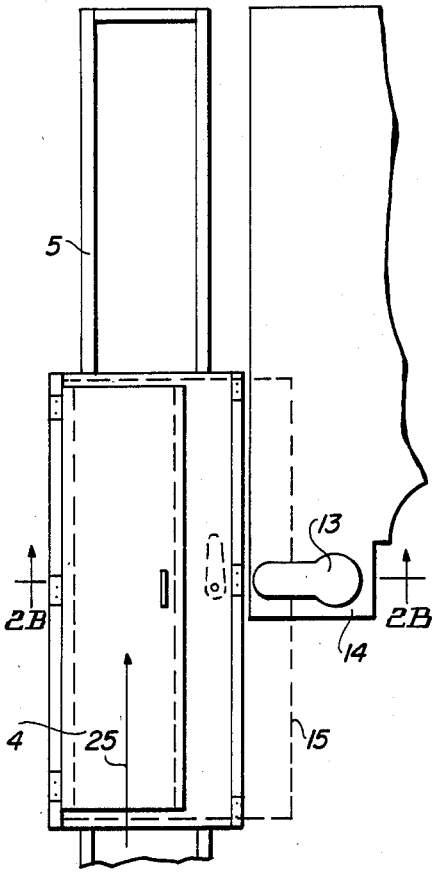

Then the serging table 1 and the fabric panels 15 are ready to be repeatedly moved back and forth on the rails 5 so that the edges of adjacent pairs of the panels 15 can be sewn together by serging machine 13. As shown in FIG. 2A, the table top 4 with the panels 15 thereon and the fabric clamp 6 lowered moves slowly in the direction of arrow 15. Preferably, a pneumatic cylinder (not shown) is actuated to control the rate and direction of movement of table top 4 past serging machine 13. In the serging process, first the two top panels of the stack are moved through the sewing head of serging machine 13, the front edges of the remaining 18 panels being dropped against leaf 9. Then the direction of table top 4 is reversed and it is moved back to its starting position. The two serged panels are flipped forward, in the manner indicated by reference numeral 18 in FIG. 2B, and the front edges of the next two adjacent panels are serged together. This procedure is repeated until the entire stack of 20 panels are serged in the foregoing fashion. Then the fabric clamp 6 is lifted. At this point, the 20 panels have then been serged together to form a single width, or section of drapery material approximately 70 feet wide from which various widths of draperies can be manufactured, as subsequently described.

Figure 3:
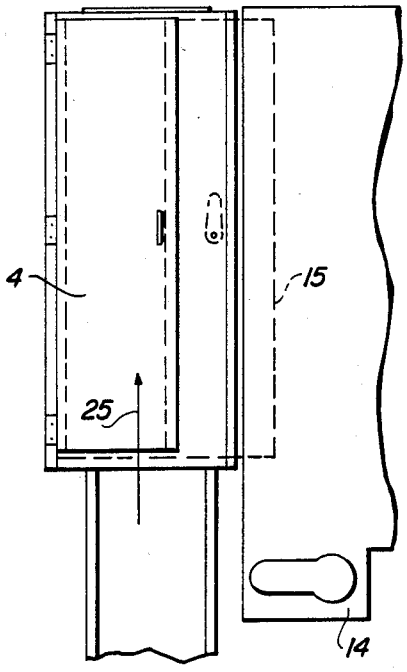

The next step in the manufacturing process is to move the table top 4 with the serged panels 15 thereon to the opposite end of rails 5, in the direction of arrow 25, as indicated in FIG. 3. The "section" of serged panels then is removed from serging table 4. The front edge of the drapery material 15, which is the bottom edge of the finished draperies, is passed through a "bottom hemming machine" 19. Hemming machine 19 is positioned on a table 14. A cutout in the front edge of table 14 allows a worker to sit close enough to easily guide the bottom edge of the section of material 15 through sewing machine 19.

Serging machine 13 can be a Brother Model B957-2C Mach Safety Stitch Machine with a ZERO/MAX roller. Bottom hemming machine can be a blindstitch machine Model B518-2 manufactured by U.S. Blindstitch.

The ZERO/MAX fabric puller 20 is attached to the top of machine 19 or table 14 to the right of the sewing head of bottom hemming machine 19, and pulls the fabric by means of a pair of rollers at the proper speed through the sewing head of bottom hemmer 19. Fabric puller 20 can be a ZERO-MAX puller which is well known to those skilled in the art.

Note that the table is curved concavely such that beyond the bottom hemming machine the fabric automaticaly partially turns the section of fabric around so it is readily positioned for the next operation.

The upper edge of the drapery material 15 is now positioned to allow a strip of buckram to be serged along the top edge of the drapery material. A buckram serging machine 22, which can be a Rimoldi 329-2CD safety stitch machine, with a ZERO/MAX puller attached, is used to serge the buckram material to the top edge of the drapery material 15. The ZERO/MAX fabric puller 23, which can be the same as fabric puller 20, is used to pull the fabric through buckram serging machine 22 at the correct rate. An operator stationed at cutout 24 guides the material through. The buckram material has stickum material on its inside surface, against the inside surface of the drapery material 15. The serged drapery and buckram material moving out of fabric puller 23 is fed into a pressing machine 53. Pressing machine 23 produces hot steam that sets the stickum on the inner side of the buckram so that the serging by serging machine 22 is adequate, since the pressing operation produces a permanent fusing or bonding between the entire inner surface of the buckram material and the inner surface of the drapery material 15.

Note that the fabric puller 23 sets the crease in the drapery fabric at the top edge of the material 15.

The next step in the manufacturing process is the pleat marking step of the present invention. The pleat marking operation is performed on portion 14A of table 14. Two slotted elongated marking guide plates 26 and 27, each approximately four inches long, are attached to the top of table 14A along the front and rear edges, respectively, thereof. Guide plate 26 has a plurality of pleat marking slots 32 therein. The spacing between each adjacent pair of pleat marking slots 32 is equal to the distance between the center lines of the to-be-formed pleats as required to produce French pleats having a depth of four inches.

Similarly, fold marking plate 27 has a plurality of slots 31 each positioned precisely opposite to corresponding pleat marking slots 32 spaced from the other by a distance equal to the fan folding width, which is the same as the spacing between the slots 32 of pleat marking guide plate 26.

Figure 5:
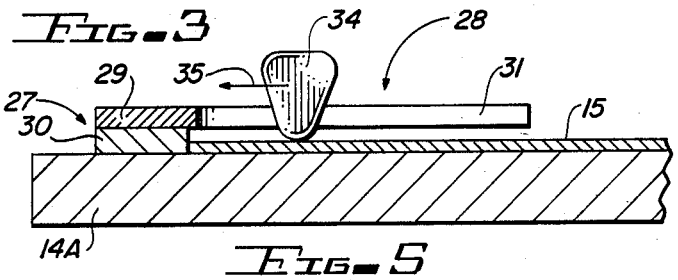
Figure 4:
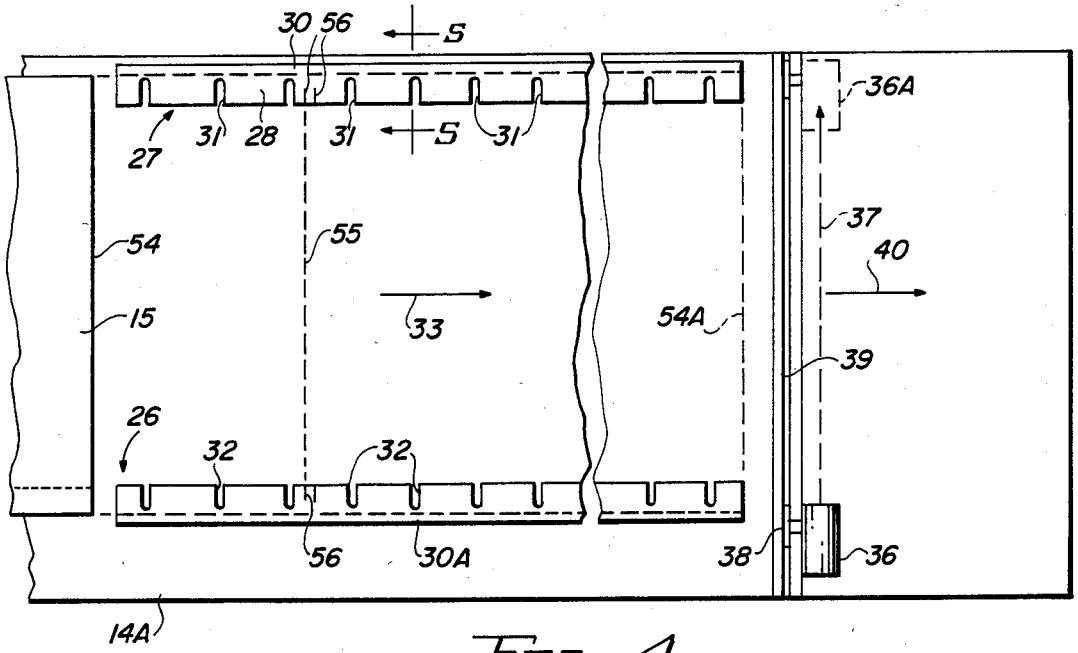

As best seen in FIG. 4 and 5, each of the slotted guide plates 26 and 27 is elevated from the top surface of table 14A by a spacer such as spacer 30 in FIG. 5. More specifically, fan fold marking guide plate 27 is supported by a spacer 30, while pleat marking guide plate 26 is supported by a spacer 30A.

In accordance with the manufacturing process of the present invention, the leading edge 54 of drapery material 15 is moved forward in the direction of arrow 33 (FIGS. 1 and 4), with the bottom hem being fed underneath fan fold marking guide plate 27 and the buckram edge being fed underneath pleat marking guide plate 26, as indicated by reference numeral 55 and arrow 33 in FIG. 4 until the leading edge 54 has advanced to the cut off blade slot 39.

At this point, an ultraviolet sensitive marking ?? 34 (FIG. 5) is inserted into each of the slots 31 and 32 so that its pointed tip presses against the upper surface of the drapery fabric 15. The ultraviolet-sensitive marker 34 is then pulled in the direction of arrow 35 along the entire length of the slots 31 and 32, making invisible marks that only become visible when illuminated by ultraviolet light; they show up as phosphorescent marks when the drapery fabric is illuminated by ultraviolet light. These pleat center marks formed with the aid of slotted guid plate 26 and fan fold marks formed with the aid of guide plate 27 greatly facilitate the pleat forming operations and fan folding operations that occur later in the manufacturing process. The ultraviolet sensitive marker 34 can be any of a variety of ultraviolet pencils or marking chalks that can be ordered through Cutter's Machine Catalogue.

After a width of the drapery fabric 15 having the proper width for a certain width drapery has been pleat marked as explained above, ultraviolet-sensitive cut-off marks can be made on the upper and lower edges of the draper fabric 15. Guide marks such as 56 are provided on the surface of the guide plates 26 and 27 to facilitate alignment of the cut-off line of the drapery material with a cut-off blade guide slot 39 (FIG. 4). A motorized cutter 36, having a high speed, smooth edged rotary blade 38 that moves through slot 39 then is moved in the direction of arrow 37 to the position indicated by dotted lines 37A, thereby cutting off a subsection of the drapery material from which one drapery is to be formed. An overhead ultraviolet light indicated by dotted line 57 in FIG. 1 makes the cut-off marks visible so they can be conveniently aligned with cut-off blade slot 39. The remaining part of the fabric 15 is now in position to conveniently perform the above operation on the next width of subsection to be cut.

After the drapery material 15 has been cut into suitable "widths", corresponding to draperies having certain predetermined widths, side hems are produced on those widths, by means of a conventional hemming machine, which can be a U.S. Blindstitch Model 718, with a ZERO/MAX puller. The side hems are turned over the top and bottom of each subsection, thereby enclosing the cut or rough edges, including the edges of the bottom hem and the buckram strip, within the side hems. This eliminates the conventional step called "end closing", in which the end edges of the bottom hem and the buckram strip are separately hemmed. Current manufacturing requires the side hems and bottom hems to be sewn prior to the buckram serging step, which leads to the need for an additional operation called "end closing." (It should be noted that, by way of definition, the length of a drapery is actually its height when it is hanging on a wall.) The width is the width of the completed drapery when it is hanging on the wall. Since this is a conventional step, it is not illustrated or described herein. After the side hems have been formed on each drapery, the next step is to preform and stitch the French pleats. This is done by means of a conventional pleat forming machine, which is schematically shown in FIG. 7A and designated by reference numeral 43. In the present embodiment of the invention, a pleat forming machine is used.

Pleat forming machine 43 includes a center blade 44 which is approximately 4 inches long, corresponding to the heigth of each French pleat. Pleat forming machine 43 includes two pivotal wings 45 connected at their lower or inner edges by means of hinges. The top edge of blade 44 is aligned with the pleat mark 41, which is illuminated and made visible by an overhead ultraviolet light 42, and therfore clearly shows up and allows the drapery 15 to be lowered onto center blade 44 and in perfect alignment therewith, as indicated in FIG. 7B. Then, a U-shaped member 46 lowered in the direction of arrow 47 on either side of center blade 44. Actually, the U-shaped member 46 is connected to a suitable hinged mechanism that keeps it precisely aligned with center blade 44 as it is lowered.

When U-shaped member 46 is at its lowest position, as indicated in FIG. 7B, the wings 45 are then raised to a vertical position parallel to center blade 44, as indicated in FIG. 7F, so that the French pleat is completely formed except for a stitching operation along dotted lines 51 for the length of each French pleat. This stitching is sometimes referred to as an "L-tacking" operation, and is preformed by means of a machine referred to as an L-tacker (not shown). An L-tacker that is used in the present embodiment of the invention is a Singer Model 269W999, with a Friedman L-tack eccentric cam attached thereto.

Figure 6:
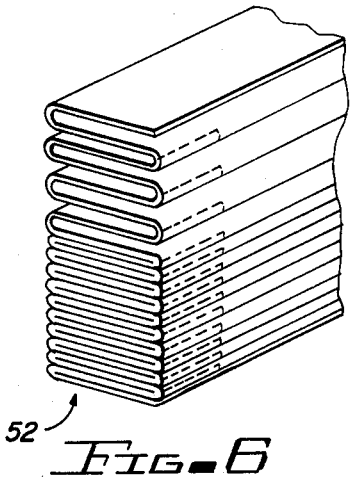

Once the pleat has been formed as indicated by reference numeral 49 in FIG. 7F, an operator holds the pleat in its formed configuration between his or her fingers and thumb, and slides it in the direction of arrow 50 off of the pleat forming machine 43 and moves the preformed pleat 49 to an adjacent L-tacker machine, which performs the L tacking operation, thereby completing the manufacture of the French pleat. After all of the pleats have been formed on a particular drapery, that drapery is fan folded. This operation is performed by positioning one worker at the top of the drapery, and the other end at the bottom. The worker at the top end simply fan folds the top edge of the drapery in accordance with each of the completed French pleats. The worker at the bottom end holds the portion of the drapery being folded under an overhead ultraviolet light, which makes the ultraviolet-sensitive marks formed through the slots 31 (FIG. 4) visible, and makes a fan fold at each of those illuminated marks to produce the fan folded configuration 52 shown in FIG. 6. The remaining steps in the manufacturing operation are entirely conventional, and are not described herein. They include a pin hooking stage in which commercially available electronically controlled automatic pin insertion devices can be conveniently used to insert the pin hooks.

The standard measure of production for modern drapery work rooms is the number of widths of drapery manufactured per day, per girl. Most commercial work rooms aim for a productivity in the range of 30 to 35 widths per day per girl. My present operation, after four months of operation, is averaging approximately 90 widths per girl per day, and we expect further improvements over the next few months. The advantages of our process and apparatus enable our factory to produce an unlimited number of different widths of draperies at approximately 50 percent of the cost of a conventional drapery factory which manufactures a variety of widths of "standard" draperies. A further benefit of the above-described process that contributes to its overall efficiency is the fact that the pleat marking machine never needs to be adjusted to make different sized French pleats, because all pleats manufactured by the process of the present invention are exactly the same size, i.e., they always have 200 percent "fullness". Another benefit is that the fence of the L-tacker machine therefore never needs to be adjusted. Both of these advantages occur because the prior art techniques require different sizes and spacing of pleats for different width draperies.

A significant benefit of the above-described invention is that on all windows and sliding glass doors of a building in which the draperies made by the present process are used, there is 100 percent uniformity in the appearance of the French pleats, whereas using French pleated draperies made by prior processes, there will be non-uniformity in the fullness and spacing of the French pleats for different sized window.

Yet another advantage of the above-described process is that the uniformity of the pleats makes it more practical to use the above-mentioned automatic pin hooking machines, as no re-adjustment of the pin hooking machine is required for draperies of different widths. In fact, some drapery manufacturers have avoided using the automatic pin hooking machines, finding that manual pin hook insertion is faster due to the amount of time required for re-adjustment of the automatic pin hooking machines for different sized draperies.

The above-described process allows use of any width of fabric and to produce French pleats without waste of any fabric at all, because pieces that are cut off can simply be serged in with the fabric panels 15 as previously described with reference to the serging table 1. This reduces, in fact nearly eliminates, fabric waste.

While the invention has been described with reference to a particular embodiment thereof, those skilled in the art will be able to make various modifications to the described method without departing from the true spirit and scope of the invention. It is intended that all drapery manufacturing processes which are equivalent to the one described herein in the sense they utilize steps which perform substantially the same work in substantially the same way to obtain substantially the same result are considered to be within the scope of the present invention. For example, although serging of individual panels together is disclosed as the way to obtain a convenient width of drapery material on which to perform the pleat marking process of the present invention, the initial panel serging step could be eliminated if satisfactory drapery material became available in large rolls of predetermined widths.

Furthermore, the particular guide mechanisms shown for making the top and bottom edges of the fabric with the pleat center marks and fan folding marks could be replaced with a computer controlled mechanism that automatically advances the fabric along the pleat marking table, halts its movement, and automatically provides the ultraviolet sensitive pleat center marks and fan folding marks at the top and bottom edges and automatically cuts desired widths of the fabric, as long as the ultraviolet sensitive fan folding marks and pleat center marks are utilized in the same manner in the fan folding and pleat forming operations.

I claim:

1. A method of making French pleated draperies, said method comprising the steps of:

(a) sewing edges of a plurality of rectangular panels of fabric together to form a relatively wide section of drapery material;

(b) sewing a bottom hem on the section of drapery material;

(c) attaching a strip of buckram material along a top edge of the section of drapery material;

(d) positioning the top edge and the bottom edge of the section of drapery material under first and second marking guide members, respectively, each of said first and second marking guide members having a plurality of parallel elongated guide slots with center to center spacing equal to distance between desired pleat center marks on the section of drapery material;

(e) guiding a tip of a marker through each of the guide slots in the first and second marking guide members against the section of drapery material and guiding the tip of the marker along the length of each guide slot to form pleat center marks and fold marks along the top and bottom edges, respectively, of the section of drapery material, the marker forming marks that are invisible in ordinary light but visible when illuminated by ultraviolet light;

(f) cutting a subsection of fabric of a desired width from the section of drapery material;

(g) sewing side hems on the subsection of fabric;

(h) forming each of a plurality of French pleats along the top edge of the subsection by illuminating the top edge of the subsection with ultraviolet light to make a pleat center mark visible and aligning that pleat center mark with a center blade of a pleat forming machine, operating the pleat forming machine to pre-form that pleat, removing the preformed pleat from the pleat forming machine, and operating an L-tacking machine to stitch that pleat; and (i) by illuminating the bottom edge of the drapery formed from the subsection with ultraviolet light to make the fan folding marks visible, fan folding the bottom edge of that drapery at each of the illuminated fan fold marks, and essentially simultaneously fan folding the top edge of that drapery at each of the French pleats.

2. The method of claim 1 wherein step (e) further includes using the marker to make an invisible cut-off mark adjacent to the first marking guide member and another cut-off marker adjacent to the second marking guide member, and wherein step (f) includes illuminating the two cut-off marks with ultraviolet light to make them visible and aligning the illuminated cut-off marks with the path of a cut-off device.

3. The method of claim 2 wherein the two cut-off guide marks are made by aligning the marker adjacent to corresponding selected indicia adjacent to the edges of the first and second marking guide members, respectively.

4. The method of claim 1 wherein step (a) includes stacking a plurality of the relatively narrow panels on a movable first table surface of a first table, aligning a first edge of each of the panels with a movable fence, lowering a fabric clamp onto the stack of panels to prevent their movement relative to the first table surface, and moving the first table past the sewing head of a first sewing machine while feeding the first edge portions of adjacent pairs of the panels through the sewing head to serge them together, making repeated passes until each adjacent pair of panels has its first edges sewn together, and feeding consecutive pairs of inner second edges of the panels to form the relatively wide section of drapery material.

5. The method of claim 4 including moving the first table surface to the end of a second table surface, removing the fabric clamp, and pulling the bottom edge of the section of drapery material through the sewing head of a bottom hemming machine by means of a first fabric puller.

6. The method of claim 5 wherein the bottom hemming machine and first fabric puller are adjacent to a front edge of the second table surface, the method further including the steps of sewing a strip of buckram material along the top edge of the section of drapery material by pulling the buckram and the top edge of the drapery material through the sewing head of a sewing machine by means of a second fabric puller, and feeding the top edge of the section of drapery material through a steam pressing machine that activates stickum on the buckram strip to permanently attach it to the material along the top edge of the section of drapery material.

7. The method of claim 3 wherein the cut-off device includes a motorized fabric cutting device with a high speed, smooth edged rotary cutting blade and a metal groove into which the cutting blade extends, the cutting groove being disposed beneath an ultraviolet light, the illuminated cut-off marks being aligned with the cutting groove during the cutting operation.

8. The method of claim 6 including moving the first table surface along a pair of supporting rails back and forth past the sewing head of the first sewing machine, by pneumatically controlling the movement of the first table surface on the rails.

9. The method of claim 1 wherein the length of each of the guide slots is approximately the same as the length of each French pleat to be formed.

10. The method of claim 9 wherein each of the guide slots is perpendicular to the top and bottom edges of the section of drapery fabric.

11. The method of claim 1 wherein the first and second marking guide members are supported above a table surface, step (d) including sliding the section of drapery material so that the top edge slides under the first marking guide member and the bottom edge slide under the second marking guide member.

12. A method of making French pleated draperies, said method comprising the steps of:

(a) attaching a strip of buckram material along a top edge of a relatively wide piece of drapery material;

(b) positioning the top edge and the bottom edge of the section of drapery material under first and second marking guide members, respectively, each of said first and second marking guide members having a plurality of parallel elongated guide slots with center to center spacing equal to the distance between desired pleat center marks on the section of drapery material;

(c) guiding a tip of a marker through each of the guide slots in the first and second marking guide members against the section of drapery material and guiding the tip of the marker along the length of each guide slot to form pleat center marks and fold marks along the top and bottom edges, respectively, of the section of drapery material, the marker forming marks that are invisible in ordinary light but visible when illuminated by ultraviolet light;

(d) forming each of a plurality of French pleats along the top edge of the section of drapery material by illuminating the top edge of the section of drapery material with ultraviolet light to make a pleat center mark visible and aligning that pleat center mark with a center blade of a pleat forming machine, operating the pleat forming machine to pre-form that pleat, removing the preformed pleat from the pleat forming machine, and operating a machine to stitch that pleat; and (e) illuminating the bottom edge of the drapery formed from the section of drapery material with ultraviolet light to make the fan folding marks visible and fan folding the bottom edge of that drapery at each of the illuminated fan fold marks.

13. A method of making pleated draperies, said method comprising the steps of:

(a) attaching a strip of buckram material along a top edge of a relatively wide piece of drapery material;

(b) laying the relatively wide piece of drapery material flat on a marking table and advancing it along the marking table so that the top edge of the relatively wide piece of drapery material is parallel to the bottom edge thereof;

(c) forming luminescent pleat center marks along the top edge of the relatively wide piece of drapery material and forming luminescent fan folding marks along the bottom edge of the relatively wide piece of drapery material, the pleat center marks and the fan folding marks being invisible in ordinary light but being visible when illuminated by light having a predetermined wavelength;

(d) forming each of a plurality of pleats along the top edge of the section of drapery material by illuminating the top edge of the section of drapery material with luminescent light of the predetermined wavelength to make a pleat center mark for that pleat visible and aligning that pleat center mark with a center blade of a pleat forming machine, operating the pleat forming machine to pre-form that pleat, removing the pre-formed pleat from the pleat forming machine, and operating a machine to stitch that pleat along its base; and (e) illuminating the bottom edge of the drapery formed from the section of drapery material with luminescent light of the predetermined wavelength to make the fan folding marks visible and manually fan folding the bottom edge of the drapery at each of the illuminated fan fold marks and fan folding the top edge of the drapery at each of the pleats.

14. An apparatus for making French pleated draperies, said apparatus comprising the steps of:

(a) means for sewing edges of a plurality of rectangular panels of fabric together to form a relatively wide section of drapery material;

(b) means for sewing a bottom hem on the section of drapery material;

(c) means for attaching a strip of buckram material along a top edge of the section of drapery material;

(d) means for positioning the top edge and the bottom edge of the section of drapery material under first and second marking guide members, respectively, each of said first and second marking guide members having a plurality of parallel elongated guide slots with center to center spacing equal to distance between desired pleat center marks on the section of drapery material;

(e) means for guiding a tip of a marker through each of the guide slots in the first and second marking guide members against the section of drapery material and guiding the tip of the marker along the length of each guide slot to form pleat center marks, and fan folding marks along the top and bottom edges, respectively, of the section of drapery material, the marker forming marks that are invisible in ordinary light but visible when illuminated by ultraviolet light;

(f) means for cutting a subsection of fabric of a desired width from the section of drapery material;

(g) means for sewing side hems on the subsection of fabric;

(h) means for forming each of a plurality of French pleats along the top edge of the subsection by illuminating the top edge of the subsection with ultraviolet light to make a pleat center mark visible and aligning that pleat center mark with a center blade of a pleat forming machine;

(i) an L-tacking machine to stitch that pleat; and (j) means for illuminating the bottom edge of the drapery formed from the subsection with ultraviolet light to make the fan folding marks visible to allow fan folding the bottom edge of that drapery at each of the illuminated fan folding marks.

15. An apparatus for making pleated draperies, said apparatus comprising:

(a) means for attaching a strip of buckram material along a top edge of a relatively wide piece of drapery material;

(b) a marking table and means for laying the relatively wide piece of drapery material flat on the marking table and advancing it along the marking table so that the top edge of the relatively wide piece of drapery material is parallel to the bottom edge thereof;

(c) means for forming luminescent pleat center marks along the top edge of the relatively wide piece of drapery material and forming luminescent fan folding marks along the bottom edge of the relatively wide piece of drapery material, the pleat center marks and the fan folding marks being invisible in ordinary light but being visible when illuminated by light having a predetermined wavelength;

(d) means for forming each of a plurality of pleats along the top edge of the section of drapery material by illuminating the top edge of the section of drapery material with luminescent light of the predetermined wavelength to make a pleat center mark for that pleat visible and aligning that pleat center mark with a center blade of a pleat forming machine;

(e) a machine for stitching that pleat along its base; and (f) means for illuminating the bottom edge of the drapery formed from the section of drapery material with luminescent light of the predetermined wavelength to make the fan folding marks visible to allow manual fan folding the bottom edge of the drapery at each of the illuminated fan fold marks.

* * * * *